US008434238B2

(12) United States Patent
Gross et al.

(10) Patent No.: US 8,434,238 B2
(45) Date of Patent: May 7, 2013

(54) HAIR DRYER WITH LIGHT SOURCE

(75) Inventors: Jeffrey D. Gross, Kenosha, WI (US); Yiu Kwong Wan, Tsuen Wan (HK); Thomas C. Maddocks, Racine, WI (US)

(73) Assignee: Andis Company, Sturtevant, WI (US)

( * ) Notice: Subject to any disclaimer, the term of this patent is extended or adjusted under 35 U.S.C. 154(b) by 1097 days.

(21) Appl. No.: 11/771,491

(22) Filed: Jun. 29, 2007

(65) Prior Publication Data

US 2009/0000141 A1 Jan. 1, 2009

(51) Int. Cl.
*F26B 19/00* (2006.01)

(52) U.S. Cl.
USPC ..... 34/96; 34/97; 132/212; 392/384; 362/96

(58) Field of Classification Search ..... 34/95, 96, 34/97, 99, 100; 132/212; 392/384, 385, 392/386; 362/96
See application file for complete search history.

(56) References Cited

U.S. PATENT DOCUMENTS

| | | | | | |
|---|---|---|---|---|---|
| 1,541,988 | A | * | 6/1925 | Meyer | 34/283 |
| 1,553,745 | A | * | 9/1925 | Buck | 34/104 |
| 1,603,117 | A | * | 10/1926 | Kimmel | 34/96 |
| 1,639,753 | A | * | 8/1927 | Shelton | 362/282 |
| 1,748,883 | A | * | 2/1930 | Kell | 348/269 |
| 1,782,626 | A | * | 11/1930 | Nicosia | 34/99 |
| 1,787,251 | A | * | 12/1930 | Jancke et al. | 34/99 |
| 1,965,090 | A | * | 7/1934 | Werner | 34/98 |
| 1,970,766 | A | * | 8/1934 | Pfahl | 237/50 |
| 1,998,159 | A | * | 4/1935 | Johnson et al. | 34/98 |
| 2,012,473 | A | * | 8/1935 | McElroy et al. | 34/100 |
| 2,014,185 | A | * | 9/1935 | Martin | 34/100 |
| 2,022,237 | A | * | 11/1935 | Grant | 34/98 |
| 2,026,942 | A | * | 1/1936 | Kelley | 34/87 |
| 2,037,998 | A | * | 4/1936 | Norquist | 126/110 D |
| 2,048,143 | A | * | 7/1936 | Seidman et al. | 34/87 |
| 2,052,799 | A | * | 9/1936 | Rifle | 237/53 |
| 2,246,767 | A | * | 6/1941 | Tays | 34/99 |
| 2,260,244 | A | * | 10/1941 | Walter | 34/104 |
| 2,293,803 | A | * | 8/1942 | Colborn | 34/100 |
| 2,332,639 | A | * | 10/1943 | Hudson | 34/553 |
| 2,428,630 | A | * | 10/1947 | Lanter | 34/99 |
| 2,430,751 | A | * | 11/1947 | Woodyard et al. | 34/97 |
| 2,466,915 | A | * | 4/1949 | Shields | 34/99 |
| 2,492,440 | A | * | 12/1949 | Reichel | 34/105 |
| 2,576,226 | A | * | 11/1951 | Huber et al. | 34/99 |
| 2,585,735 | A | * | 2/1952 | Bunting | 34/99 |
| 2,663,090 | A | * | 12/1953 | Flaxman | 34/99 |
| 2,782,527 | A | * | 2/1957 | Schweitzer et al. | 34/99 |

(Continued)

FOREIGN PATENT DOCUMENTS

EP 0 801 263 A2 10/1997

OTHER PUBLICATIONS

Milwaukee heat gun operatng manual Oct. 2004 www.milwaukeetool.com.*
Steinel heat gun manual www.steinel.net not dated.*

(Continued)

*Primary Examiner* — Stephen M. Gravini
(74) *Attorney, Agent, or Firm* — Michael Best & Friedrich LLP

(57) ABSTRACT

A hair dryer. The hair dryer includes a housing having a nozzle portion terminating at a drying end. The housing defines a cavity. The hair dryer further includes at least one light source coupled to the housing and positioned to direct light towards a work area proximate the drying end.

23 Claims, 6 Drawing Sheets

U.S. PATENT DOCUMENTS

| | | | | | |
|---|---|---|---|---|---|
| 2,897,603 | A | * | 8/1959 | Behrman | 34/99 |
| 2,949,678 | A | * | 8/1960 | Anderson | 34/105 |
| 3,000,107 | A | * | 9/1961 | Ryan | 34/102 |
| 3,203,112 | A | * | 8/1965 | Edmonds | 34/104 |
| 3,377,715 | A | * | 4/1968 | Hubner | 34/99 |
| 3,438,138 | A | * | 4/1969 | Bachrach et al. | 34/105 |
| 3,604,915 | A | | 9/1971 | Wahl | |
| 3,610,881 | A | | 10/1971 | Stewart | |
| 3,777,407 | A | * | 12/1973 | Leisenberg | 34/105 |
| 3,786,575 | A | * | 1/1974 | Riblett | 34/99 |
| 3,836,750 | A | * | 9/1974 | Caruso | 392/379 |
| 3,852,891 | A | * | 12/1974 | Stephan | 34/95 |
| 4,132,012 | A | * | 1/1979 | Saloom | 34/105 |
| 4,135,080 | A | * | 1/1979 | Wells, Jr. | 392/385 |
| 4,171,580 | A | * | 10/1979 | Vabrinskas | 34/104 |
| 4,198,765 | A | * | 4/1980 | Miyamae | 34/104 |
| 4,233,733 | A | | 11/1980 | Gallanis et al. | |
| 4,250,630 | A | * | 2/1981 | Moses | 34/104 |
| 4,250,631 | A | * | 2/1981 | Moses | 34/104 |
| 4,274,199 | A | | 6/1981 | Gallanis et al. | |
| 4,514,618 | A | | 4/1985 | Majthan et al. | |
| 4,523,389 | A | * | 6/1985 | Diggle et al. | 34/105 |
| 4,605,019 | A | * | 8/1986 | Reynolds et al. | 132/272 |
| 4,802,287 | A | | 2/1989 | Chen | |
| 4,882,467 | A | * | 11/1989 | Dimick | 219/219 |
| 4,890,395 | A | * | 1/1990 | Yamac | 34/96 |
| 4,914,273 | A | * | 4/1990 | Matsui | 219/222 |
| 4,928,402 | A | * | 5/1990 | Allen | 34/97 |
| 4,979,308 | A | | 12/1990 | Moore | |
| 4,991,314 | A | * | 2/1991 | Allen | 34/98 |
| 5,161,317 | A | * | 11/1992 | McDougall | 34/97 |
| 5,351,417 | A | | 10/1994 | Rubin | |
| 5,434,386 | A | | 7/1995 | Glenn et al. | |
| 5,511,322 | A | | 4/1996 | Fertig | |
| D372,189 | S | | 7/1996 | Andis et al. | |
| 5,553,632 | A | * | 9/1996 | Burkhardt | 132/271 |
| 5,568,691 | A | | 10/1996 | Rubin | |
| 5,608,975 | A | * | 3/1997 | Hsu | 34/97 |
| 5,638,339 | A | | 6/1997 | DeLoretto et al. | |
| 5,640,781 | A | * | 6/1997 | Carson | 34/97 |
| 5,720,108 | A | * | 2/1998 | Rice | 34/104 |
| 5,761,824 | A | * | 6/1998 | Moon et al. | 34/97 |
| 5,823,869 | A | | 10/1998 | Paturzo | |
| 5,937,537 | A | * | 8/1999 | Miller | 34/97 |
| 5,970,616 | A | | 10/1999 | Wahl et al. | |
| 6,026,590 | A | | 2/2000 | Picozza et al. | |
| 6,026,821 | A | | 2/2000 | Last | |
| 6,067,714 | A | | 5/2000 | Taylor et al. | |
| 6,212,790 | B1 | * | 4/2001 | Stetson | 34/97 |
| 6,285,828 | B1 | | 9/2001 | Cafaro | |
| 6,408,533 | B2 | * | 6/2002 | Sakamoto | 34/97 |
| 6,449,870 | B1 | * | 9/2002 | Perez et al. | 34/96 |
| 6,647,639 | B1 | * | 11/2003 | Storrer | 34/104 |
| 6,718,651 | B2 | * | 4/2004 | Perez et al. | 34/96 |
| 6,724,984 | B2 | * | 4/2004 | Kakuya et al. | 392/412 |
| 6,871,402 | B2 | | 3/2005 | Bader et al. | |
| 7,469,487 | B2 | * | 12/2008 | Macher et al. | 34/104 |
| 2001/0025430 | A1 | * | 10/2001 | Sakamoto | 34/96 |
| 2002/0108264 | A1 | * | 8/2002 | Perez et al. | 34/96 |
| 2002/0112362 | A1 | * | 8/2002 | Correa et al. | 34/96 |
| 2003/0079367 | A1 | | 5/2003 | Troletti | |
| 2003/0167638 | A1 | | 9/2003 | Bader et al. | |
| 2004/0216322 | A1 | * | 11/2004 | Collier et al. | 34/97 |
| 2005/0091866 | A1 | * | 5/2005 | Attaway et al. | 34/96 |
| 2006/0070255 | A1 | * | 4/2006 | Kokuo et al. | 34/96 |
| 2006/0236557 | A1 | * | 10/2006 | Bousfield | 34/96 |
| 2007/0137060 | A1 | * | 6/2007 | Woodson | 34/97 |
| 2008/0141551 | A1 | * | 6/2008 | Brown-Carter | 34/92 |
| 2009/0000141 | A1 | * | 1/2009 | Gross et al. | 34/90 |
| 2009/0000143 | A1 | * | 1/2009 | Bazzicalupo et al. | 34/97 |

OTHER PUBLICATIONS

Black & Decker heat gun operating instructions for catalog Nos. HG1000 and 9756 type 300 copyrighted 2003.*

Black & Decker paint remover and heat gun instruction manual for catalog No. 9756 copyrighted 1995.*

* cited by examiner

HAIR DRYER WITH LIGHT SOURCE

BACKGROUND

The present invention relates to an apparatus for drying hair, and in particular, a hair dryer with a light source.

Drying the hair of a person or an animal, in particular a large animal, in a dimly lit area poses a variety of difficulties, including over-drying or under-drying of the hair. Light bulbs and other external illumination methods are frequently inadequate for proper work area visualization for a variety of reasons, including the light being cumbersome or insufficient to adequately light the hair being dried. Professionals or others drying hair may also use brushes or other tools to add body or curls to the hair as it is drying. When the work area and the hair being dried are insufficiently illuminated, inefficiencies in drying exist because the condition of the hair cannot be readily ascertained.

SUMMARY

In one embodiment, the invention provides a hair dryer including a housing having a nozzle portion terminating at a drying end. The housing defines a cavity. The hair dryer further includes a one light source coupled to the housing and positioned to direct light towards a work area proximate the drying end.

In another embodiment, the hair dryer includes a housing having a nozzle portion having a first end and a drying end. The housing defines a cavity and includes an aperture formed in the housing proximate the first end of the nozzle portion. The hair dryer further includes a holder and a light source supported by the holder and received by the aperture. The light source is positioned to direct light towards a work area adjacent to the drying end of the nozzle portion.

In another embodiment, the hair dryer includes a housing having a main portion and a nozzle portion terminating at a drying end. The housing defines a cavity and having apertures formed therein. The hair dryer includes a holder coupled to the housing and light sources supported by the holder and positioned substantially around a circumference of the nozzle portion. Each light source directs light through one of the plurality of apertures in the housing towards a work area adjacent to the drying end.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
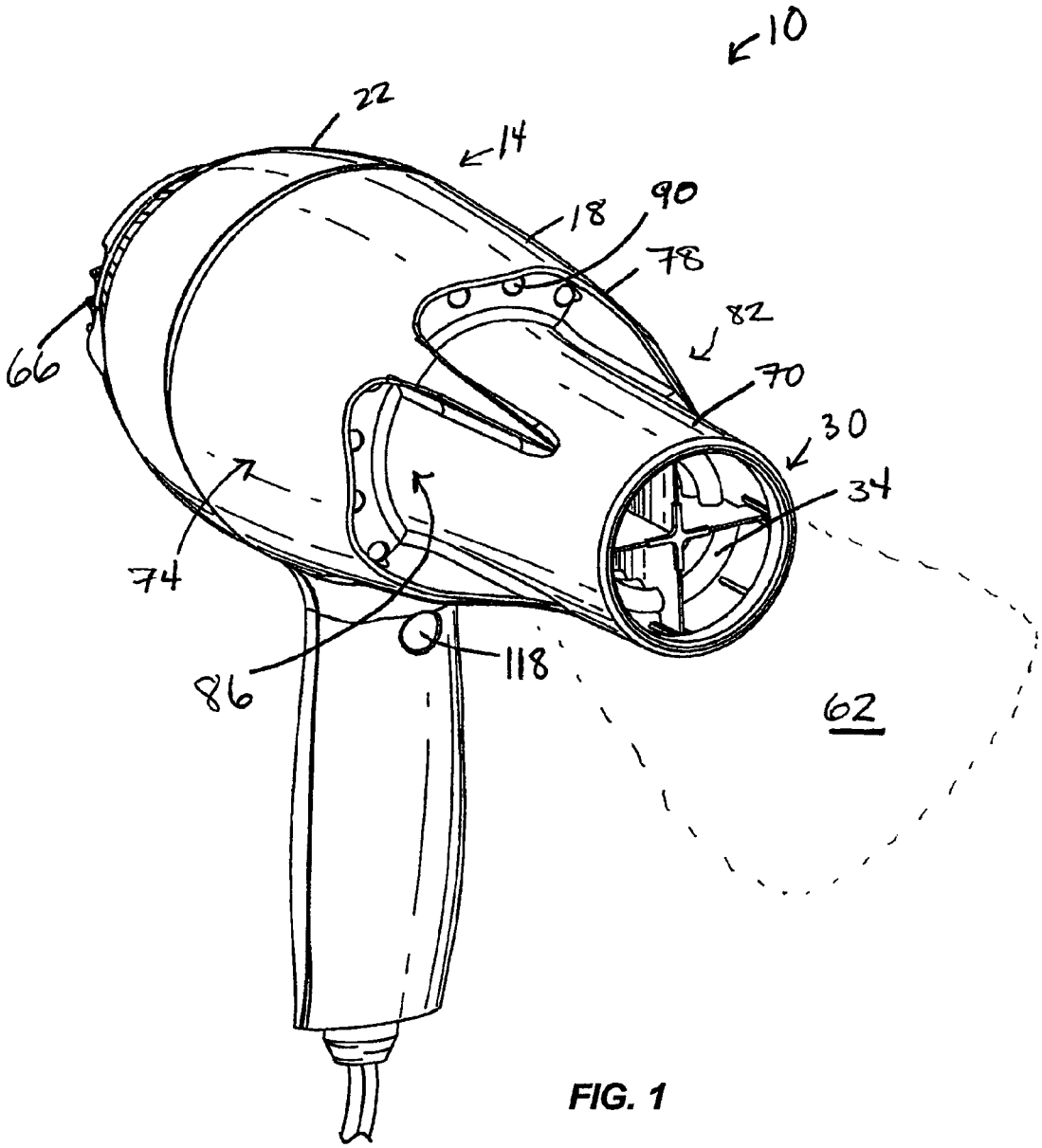
FIG. 1 is a front perspective view of a hair dryer according to one embodiment of the invention.
Figure 2:
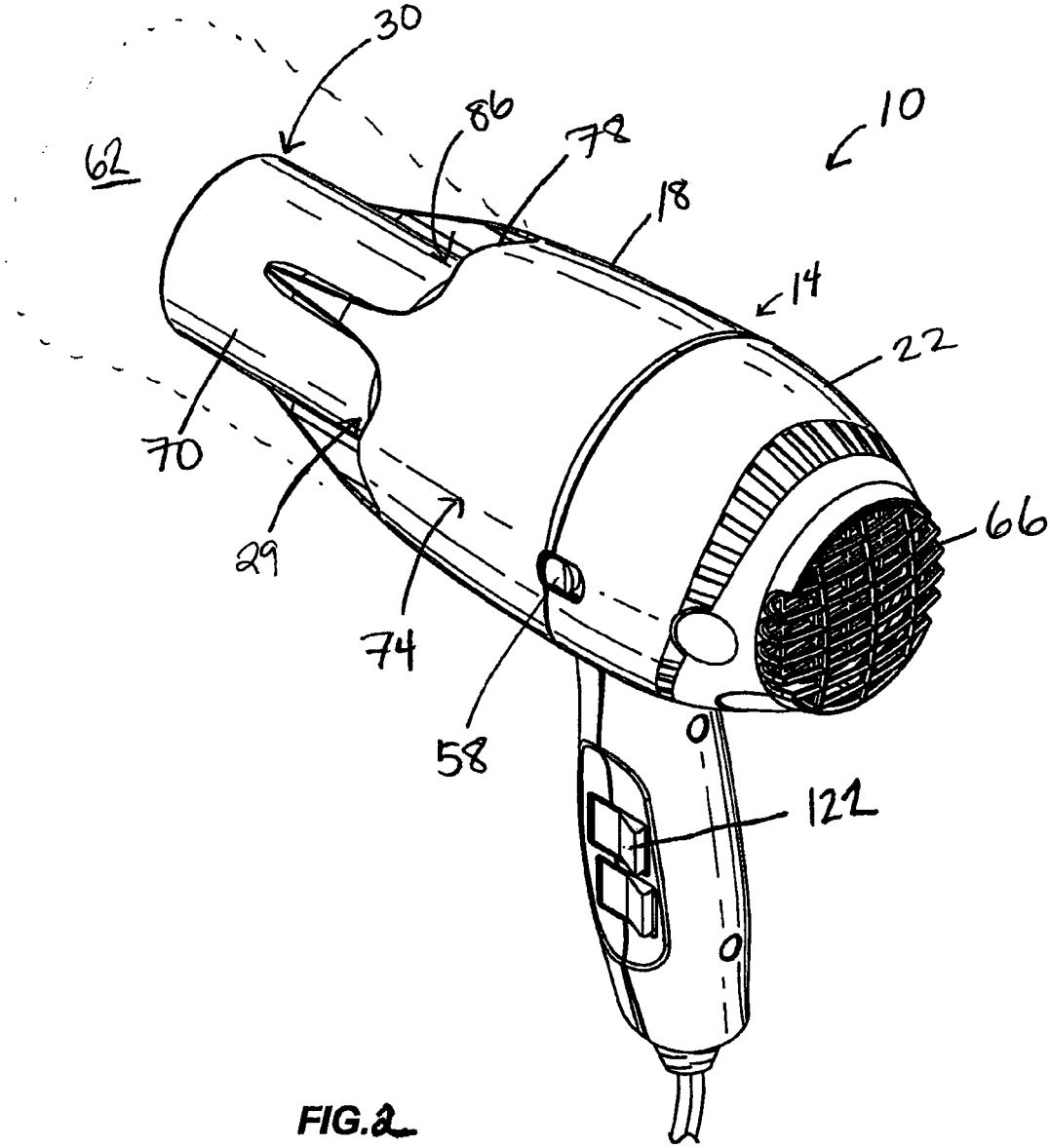
FIG. 2 is a rear perspective view of the hair dryer.

FIGS. 1-5 illustrate a hair dryer 10 and hair dryer components according to one embodiment of the present invention. More specifically, FIGS. 1-2 illustrate front and rear perspective views of the hair dryer 10. FIGS. 3-5B illustrate more detailed views of the hair dryer 10 and hair dryer components.

The hair dryer 10 includes a hollow, elongated housing 14 having a forward housing 18 and a rear housing 22 and defining an inner cavity 26. The forward housing 18 includes a drying end 30. The housing 14 substantially houses and surrounds various dryer components, substantially located in the inner cavity 26, including, but not limited to, a heating element 34, a fan 38, a motor 42, a light source holder 46, light sources 50, and a shroud portion 54. The forward housing 18 and the rear housing 22 are coupled by a fastening mechanism 58 (FIG. 2), including but not limited to, a snap and lock mechanism, a push button, or other fastening device or mechanism. In the illustrated embodiment, the fastening mechanism 58 includes a button actuator, which allows a user to decouple the forward housing 18 and rear housing 22 and gain access to the dryer components.

In operation, air flow is created by the fan 38 and the air flows through the heating element 34 toward the drying end 30 of the housing 14. Air exits the hair dryer 10 at the drying end 30 where the air acts upon the hair in a work area 62 adjacent the drying end 30. Light emitted from the light sources 50 is independent and separate of the air flow. Additionally, the light sources may be operated independently of the fan 38.

Figure 3:
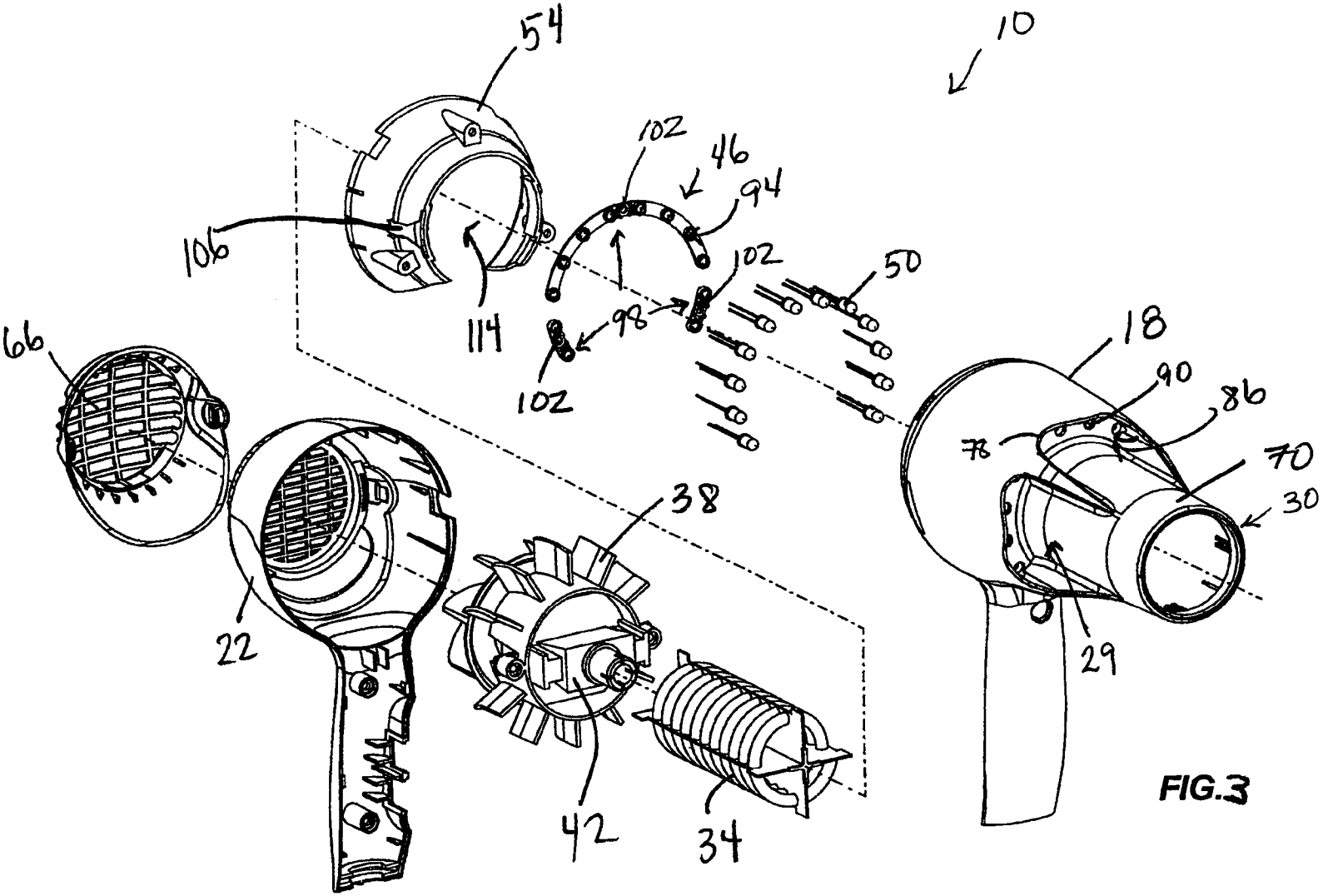
FIG. 3 is an exploded view of the hair dryer of FIG. 1.
Figure 4:
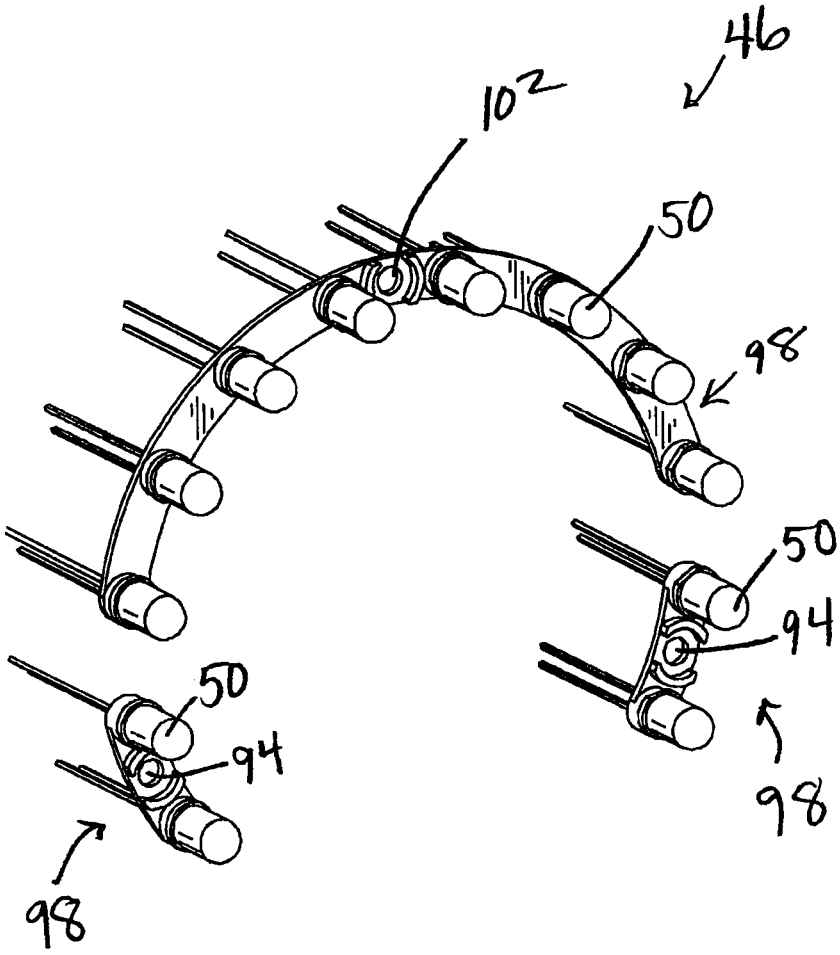
FIG. 4 is a front perspective view of a light source holder of the present invention, including light sources.

The hair dryer 10 includes the cavity 26 defined by both the forward housing 18 and the rear housing 22. The rear housing 22 includes an exhaust panel 66 configured to allow exhaust to exit the dryer 10. The forward housing 18 includes a nozzle 70. The nozzle 70 has a first end 29 and a drying end 30 (FIGS. 2 and 3). The drying end 30 is positioned at one end of the nozzle 70. The nozzle 70 has a smaller width than a main portion 74 of the forward housing 18 and includes a shoulder 78 defined at a transition area 82 between the main portion 74 and the nozzle 70. In the illustrated embodiment, the transition area 82 provides a recess 86 that substantially surrounds the nozzle 70. In the illustrated embodiment, the recess 86 includes recess apertures 90 that receive the light sources 50. The light sources 50 are positioned to direct light through the recess apertures 90 and toward the work area 62 adjacent the drying end 30.

Referring to FIG. 3, the hair dryer 10 includes the holder 46 positioned in the cavity 26 rearward of the nozzle 70 and forward of the shroud portion 54. The holder 46 is configured to receive the light sources 50 and position the light sources 50 in the apertures 90. The holder 46 includes a plurality of holder apertures 94 formed therein for receiving a plurality of light sources 50. In the illustrated embodiment, the holder 46 includes three holder portions 98. Each holder portion 98 is configured to receive at least one light source 50. In other embodiments, the holder 46 may include one, two, four or more holder portions 98. Each of the holder portions 98 includes a fastening aperture 102 to couple the holder portion 98 to the shroud portion 54. The fastener may be a screw, nail, clip or similar fastening apparatus. In the illustrated embodiments, the apertures are circular, but in a further embodiment, the apertures may be other shapes, for example, square. Further, the holder portion may include fewer or more apertures corresponding to the number of light sources.

The shroud portion 54 is positioned in the cavity 26 rearward of the holder 46. The shroud portion 54 is configured to support the holder 46 and prevent interference of air flow within the cavity 26 by the presence of the light sources 50 and holder 46. More specifically, the shroud portion 54 provides a mounting area for the light source 50 and provides a shielding function for minimal disruption to the air flow of the dryer 10. The shroud portion 54 maintains an effective air flow pattern throughout the dryer 10 even with the light source 50, such that the air flow is not interrupted, swirling, or otherwise inconsistent to result in hot spots on the heating element 34, which may lead to premature failure of the heating element 34.

Figure 5A:
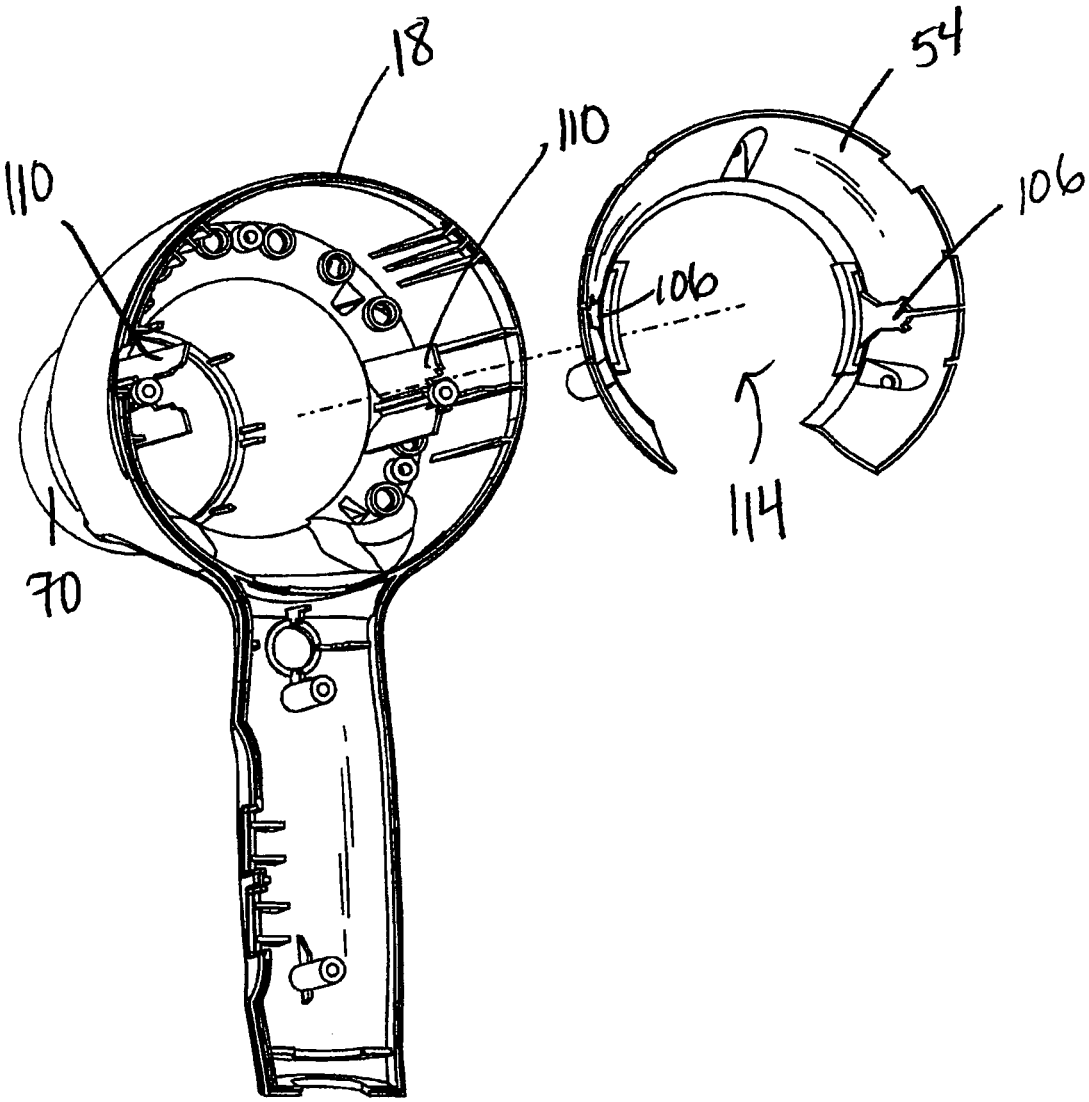
FIG. 5A is an exploded rear view of the forward portion of the hair dryer.
Figure 5B:
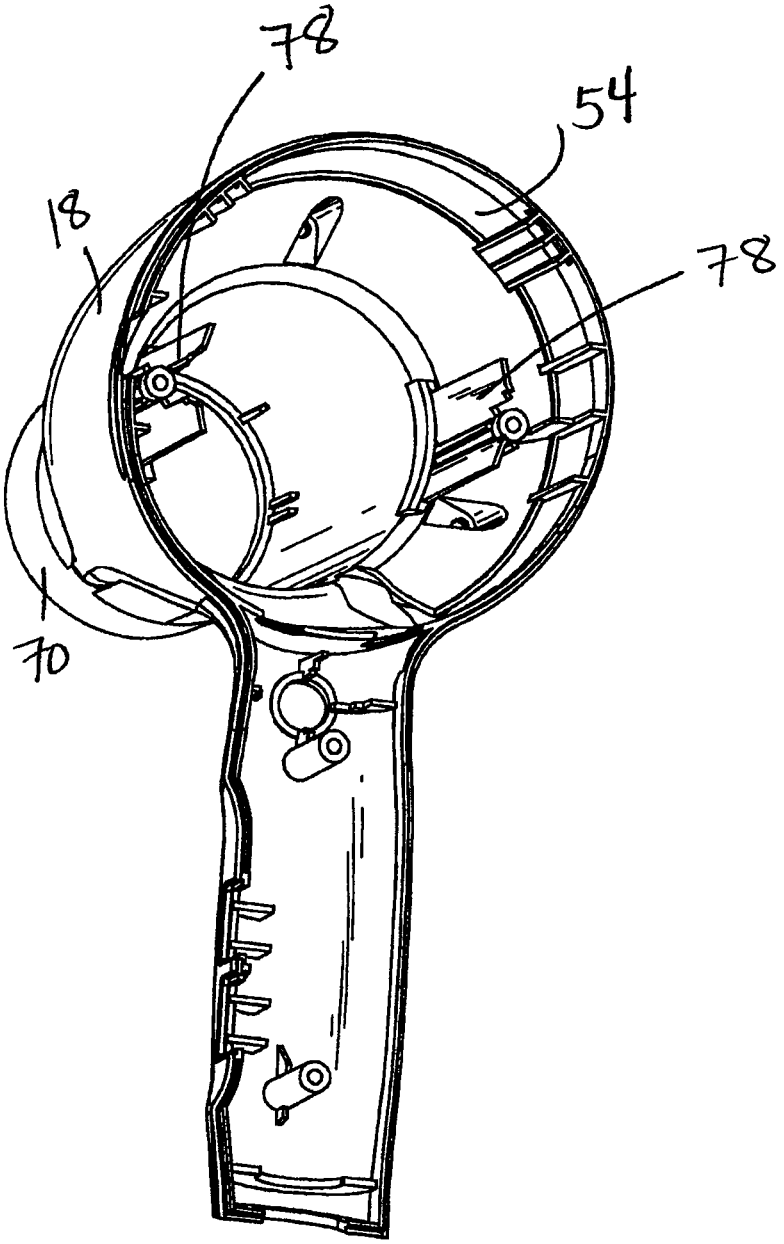
FIG. 5B is a rear view of the forward portion of the hair dryer.

As illustrated in FIGS. 5A and 5B, the shroud portion 54 includes shroud apertures 106, each configured to receive a fastening extension 110 on the forward housing 18. The fastening extension 110 extends from an inner surface of the forward housing 18 into the cavity 26 of the hair dryer 10. Each fastening extension 110 is received and retained in the respective shroud aperture 106 to couple the shroud portion 54 to the forward housing 18. The shroud portion 54 further includes a central opening 114 to allow air flow through the hair dryer 10.

In operation, the light sources 50 are retained by the holder 46 and placed in the recess apertures 90 to provide lighting in the work area 62. The holder 46 is supported within the cavity 26 by a shroud portion 54. The shroud portion 54 supports the holder 46 by coupling the holder 46 to the forward housing 18.

The hair dryer 10 further includes a light switch 118 (FIG. 1) adapted to operate the light sources 50 independent of hair dryer 10 operation. The light switch 118 is positioned on the forward housing 18 and electrically coupled to circuitry of the light sources 50 to activate or deactivate the light sources 50 upon manual actuation by a user. In some embodiments, the switch is positioned on the rear housing 22. The hair dryer further includes a dryer switch 122 (FIG. 2) adapted to operate the hair dryer independent of the light sources 50.

In the illustrated embodiment, the light sources 50 are light-emitting diodes (LEDs) that emit white light, although any number of light colors may be used. The LEDs also allow for cool running temperatures of the light sources 50 and operate on low amounts of power. In the illustrated embodiment, the light sources 50 are arranged in a circular arrangement substantially surrounding the periphery of the nozzle 70. In a further embodiment, the recess apertures 90 may be in a linear or a non-linear arrangement, wherein one aperture may be in a more forward position than an adjacent aperture. The apertures may also be at various angles within the recess so that the light sources are directed at various angles to illuminate the work area adjacent the drying end. In a further embodiment, other light sources may be used, such as fiber optics, light bulbs, light tubes, or the like.

Placement of the light sources on the periphery of the housing prevents interference with other hair dryer attachments, such as a diffuser and the like. The light sources are also placed on the periphery of the nozzle of the hair dryer to avoid interference with the fan, motor and the heating element. Additionally, placement of the light sources rearward of the heating element aids in keeping the light sources cool.

Other embodiments of the present invention may utilize combinations of the above embodiments. The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention as set forth in the appended claims.

What is claimed is:

1. A hand-held hair dryer comprising:

a housing having a main portion and a nozzle portion terminating at a drying end, an interior of the housing defining a cavity and an air flow path, the air flow path extending through the cavity to the drying end of the nozzle portion, an exterior of the housing defining a handle portion and a shoulder, the shoulder positioned between the nozzle portion and the main portion on the exterior of the housing; and a light source coupled to the housing and positioned on the shoulder outside the cavity and outside the air flow path, wherein the light source is positioned to direct light in a path along the exterior of the housing from the shoulder towards a work area proximate the drying end of the nozzle portion, such that the light path is separate from the air flow path.

2. The hair dryer of claim 1, and further comprising a holder coupled to the housing and configured to support the light source.

3. The hair dryer of claim 2 wherein the holder includes a plurality of apertures formed therein, each aperture receiving a light source.

4. The hair dryer of claim 3 wherein the holder comprises three holder portions, each holder portion configured to receive at least one light source.

5. The hair dryer of claim 2, and further comprising a shroud portion coupled to the housing and positioned in the cavity rearward of the nozzle, wherein the holder is supported by the shroud portion.

6. The hair dryer of claim 5 wherein the shroud portion includes an aperture configured to receive a fastening extension on the housing to couple the shroud portion to the housing.

7. The hair dryer of claim 5 wherein the holder includes a fastening aperture to couple the holder to the shroud portion.

8. The hair dryer of claim 1 wherein the light source is a light emitting diode.

9. The hair dryer of claim 1, and further comprising a switch adapted to operate the light source independent of a hair dryer fan.

10. A hand-held hair dryer comprising:

a housing having a main portion, a handle portion, and a nozzle portion, the nozzle portion having a first end and a drying end, the drying end defining an outlet, an interior of the housing defining a cavity in the main portion and an air flow path between the cavity and the drying end, the air flow path passing through the outlet, an aperture formed in an exterior of the housing at the first end of the nozzle portion;

a holder; and a light source supported by the holder and the light source received by the aperture formed in the exterior of the housing, wherein the light source is positioned outside the housing and outside the air flow path between the drying end and the main portion to direct light in a path along the exterior of the housing towards a work area adjacent to the drying end of the nozzle portion, such that the light path is separate from the air flow path.

11. The hair dryer of claim 10 wherein the holder includes a plurality of apertures formed therein, each aperture receiving one of a plurality of light sources.

12. The hair dryer of claim 11 wherein the holder comprises three holder portions, each holder portion configured to receive at least one light source.

13. The hair dryer of claim 10 wherein the housing includes a shroud coupled to the housing and positioned in the cavity rearward of the nozzle, and further wherein the holder is supported by the shroud.

14. The hair dryer of claim 13 wherein the holder includes a fastening aperture to couple the holder to the shroud.

15. The hair dryer of claim 13 wherein the shroud includes an aperture configured to receive a fastening extension on the housing to couple the shroud portion to the housing.

16. The hair dryer of claim 10 wherein the light source is a light emitting diode.

17. The hair dryer of claim 10, and further comprising a switch adapted to operate the at least one light source independent of a hair dryer fan.

18. A hand-held hair dryer comprising:

a housing having a main portion, a handle portion, and a nozzle portion, the nozzle portion terminating at a drying end, the drying end defining an outlet, the housing defining a cavity and an air flow path, the air flow path extending from the cavity to the drying end and passing through the outlet, apertures formed in an outer surface of the housing;

a holder coupled to the housing;

light sources supported by the holder and positioned outside the air flow path between the drying end of the nozzle portion and the main portion of the housing substantially around a circumference of the nozzle portion, wherein each light source is received within one of the apertures formed in the outer surface of the housing; and a light path extending from each light source within the aperture and towards a work area adjacent to the drying end of the nozzle portion along the outer surface of the housing, such that the light path does not cross the air flow path between the cavity of the housing and the drying end of the nozzle portion.

19. The hair dryer of claim 18, and further comprising a shoulder defined by the housing and positioned between the main portion and the nozzle portion, wherein the shoulder extends about a portion of the circumference of the nozzle portion.

20. The hair dryer of claim 19 wherein the apertures are formed in the shoulder.

21. The hair dryer of claim 19 wherein the holder is coupled to the shoulder and positioned substantially about the circumference of the nozzle portion.

22. The hair dryer of claim 18 wherein the housing includes a shroud coupled to the housing and positioned in the cavity rearward of the nozzle, wherein the holder is coupled to the shroud.

23. The hair dryer of claim 18 wherein the holder includes a plurality of apertures, and each aperture receives one of the light sources.

* * * * *